United States Patent [19]

Rango

[11] Patent Number: 4,799,684

[45] Date of Patent: Jan. 24, 1989

[54] GOLF PUTTER INCLUDING DIVOT REPAIR DEVICE

[76] Inventor: Joseph F. Rango, 74470 Fairway Dr., Palm Desert, Calif. 92260

[21] Appl. No.: 111,864

[22] Filed: Oct. 23, 1987

[51] Int. Cl.[4] ..... A63B 53/00

[52] U.S. Cl. ..... 273/162 F; 273/32 B

[58] Field of Search ..... 273/162 F, 32 B, 162 D, 273/162 R, 32 A; 294/19.2

[56] References Cited

U.S. PATENT DOCUMENTS 3,456,737 7/1969 Rhyme ..... 273/162 F 4,114,878 9/1978 Hammond ..... 273/32 B

FOREIGN PATENT DOCUMENTS 2128485 5/1984 United Kingdom ..... 273/162 D

*Primary Examiner*—George J. Marlo

*Attorney, Agent, or Firm*—I. Louis Wolk

[57] ABSTRACT

A golf putter including a shaft having a hand grip which surrounds the upper end of the shaft, and a divot mending device positioned within such hollow end. The divot mending device includes (a) a tined strip which provides divot mending capability, (b) a conical sleeve formed of resilient material the lower end of which surrounds and engages the upper end of said tined strip, (c) the upper end portion of said conical sleeve being dimensioned to frictionally slide within and engage the interior wall of said hollow portion at the end of said shaft and become wedged therein under pressure, and (d) said conical sleeve being shaped at its upper extremity to form an end cap for said shaft.

1 Claim, 1 Drawing Sheet

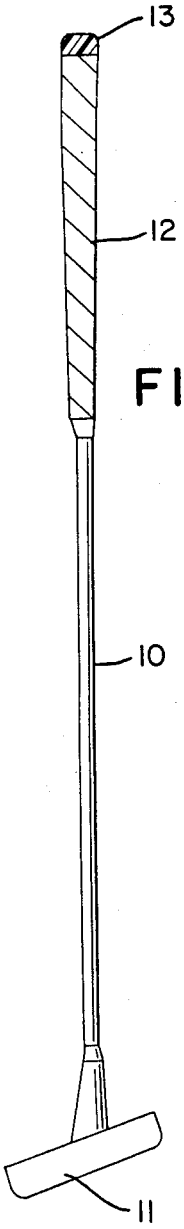
FIG. 1
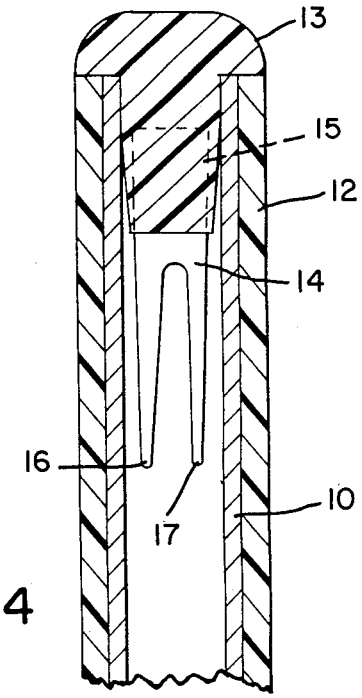
FIG. 4
FIG. 3
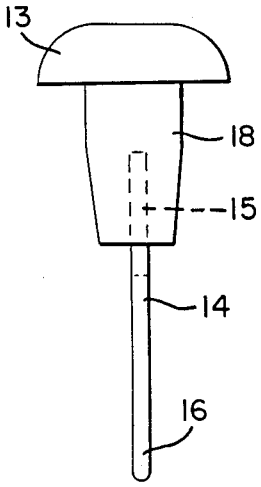
FIG. 2
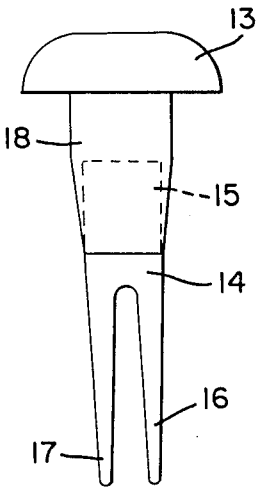

GOLF PUTTER INCLUDING DIVOT REPAIR DEVICE

BACKGROUND OF THE INVENTION

In the game of golf the putting green must be free as possible from surface irregularities which may be caused by balls striking the green during play. These irregularities are commonly known as divots. It is the obligation of the players to remove or mend these divots as they occur. This is frequently done by smoothing or lifting of the indented areas by means of a device which may be formed with two or more tines or prongs. Usually, this device is carried in a pocket of a golf bag or on the person of a player, and as is the case with loose devices may be lost or forgotten so as not to be available when required. The prongs of such loose devices are cumbersome and may also damage clothing.

SUMMARY OF THE INVENTION

In accordance with applicant's invention he has designed a divot mending tool which can be inserted and retained within the grip end of a golf shaft and which consists of a tined implement mounted upon a holder which forms the cap of the club over the grip. The tine carrying element, integral with or embedded within said cap and formed with a tapered or conical member surrounding said element beneath said cap is dimensioned to enter and firmly engage the open hollow end portion of the shaft in a position which encloses the unit within the grip and permits the holder to close the end of the shaft. For convenience and availability on the putting green, the device is preferably incorporated in the shaft of a putter.

BRIEF DESCRIPTION OF THE INVENTION

As shown in the drawings

FIG. 1 is a view in perspective of a golf putter with the device enclosed within the shaft end.

FIG. 2 is a front view in elevation of the mending unit itself.

FIG. 3 is a side view in elevation of the mending unit.

FIG. 4 is a view in cross section showing this mending unit as it is inserted at the end of the club shaft of FIG. 1.

DETAILED DESCRIPTION

As shown in the drawings, FIG. 1 illustrates a golf putter having a shaft 10, a putting head 11 and grip 12. At the end of the grip the divot mending device of the inventor is inserted with its handle in the form and shape of an end cap of the grip as shown at 13.

The divot device is illustrated in greater detail in FIGS. 2 and 3 which describe a double tined flat member 14 having its upper end firmly embedded or integrally formed at 15 in a circular cap 13 which is composed of rigid or semi rigid natural or synthetic rubber or plastic, shaped to form or replace the original end cap of the club. Member 14 is provided with a pair of tines 16, 17. Surrounding member 14, around its upper portion immediately beneath cap 13, is a tapered slightly conical sleeve 18 which is dimensioned to slide within and releasably engage the inside of the hollow shaft similar to a bottle cork. This sleeve can be formed of semi rigid or slightly resilient material such as rubber or plastic or may be of metal since it can be wedged within the hollow shaft under pressure. In this way the device can be retained within the grip end of the club shaft, withdrawn for use and replaced for storage. The entire assembly may be also made in one piece of plastic or natural or synthetic rubber molded of rigid or semi rigid material or may be molded in metal. Alternatively, the tined portion may be formed of a metal strip embedded in a rubber or plastic cap and also embedded in the tapered member.

The manner in which the device is positioned in the club is further illustrated in FIG. 4 which shows cap 13, tined member 14 with prongs 16 and 17 and sleeve 18 as they are positioned in the grip end of the club with tapered portion 18 engaging the inner surface of the club shaft 10 and surrounding grip portion 12. As shown in FIG. 4 the device is integrally formed as a unit of molded regid or semi rigid plaster or rubber. It may also be formed of metal in one piece or assembled with a plastic or rubber cap and sleeve as stated above.

The dimensions of the device are selected to conform to the inner diameter of the hollow club shaft at its grip end with the tined member may vary, for example—preferably having a length of about 3–4 inches and a width of $\frac{1}{2}$–$\frac{3}{4}$ inches. It may be formed of steel or other rigid material with perhaps a slight degree of flexibility as well as plastic.

In use, the player upon reaching the green can readily remove this ever ready and ever handy device and by reaching down gently remove the divot formed by the landing of the ball by lifting and stroking the grass turf beneath to restore the desired surface.

This device can be incorporated in an existing putter by cutting off the end of the grip at the shaft end or butt, and replacing it with the divot mender which is inserted within the grip as shown. The cap on the mender thus replaces the original cap.

I claim:

1. A golf putter comprising a shaft having a hand grip at the end thereof which surrounds a hollow portion of said shaft, and a divot mending device positioned within the hollow end of said shaft and removable therefrom, said divot mending device comprising (a) a tined strip which provides divot mending capability;

(b) a conical sleeve formed of resilient material the lower end of which surrounds and engages the upper end of said tined strip;

(c) the upper end portion of said conical sleeve being dimensioned to frictionally slide within and engage the interior wall of said hollow portion at the end of said shaft and become wedged therein under pressure;

(d) said conical sleeve being shaped at its upper extremity to form an end cap for said shaft.

* * * * *